United States Patent [19]

Pahade et al.

[11] 4,453,957

[45] Jun. 12, 1984

[54] DOUBLE COLUMN MULTIPLE CONDENSER-REBOILER HIGH PRESSURE NITROGEN PROCESS

[75] Inventors: Ravindra F. Pahade, North Tonawanda; John H. Ziemer, Grand Island; Harry Cheung, Buffalo, all of N.Y.

[73] Assignee: Union Carbide Corporation, Danbury, Conn.

[21] Appl. No.: 446,363

[22] Filed: Dec. 2, 1982

[51] Int. Cl.[3] ..... F25J 3/04

[52] U.S. Cl. ..... 62/25; 62/28; 62/29; 62/31; 62/33; 62/34

[58] Field of Search ..... 62/23, 24, 27, 28, 29, 62/31, 32, 33, 34, 25

[56] References Cited

U.S. PATENT DOCUMENTS

| | | | |
|---|---|---|---|
| 2,873,583 | 2/1959 | Potts et al. | 62/14 |
| 3,203,193 | 8/1965 | Ruhemann et al. | 62/13 |
| 3,210,947 | 10/1965 | Dubs et al. | 62/13 |
| 3,217,502 | 11/1965 | Keith, Jr. | 62/13 |
| 3,270,514 | 9/1966 | Kamlani | 62/29 |
| 3,348,385 | 10/1967 | Kamlani et al. | 62/29 |
| 3,375,673 | 4/1968 | Cimler et al. | 62/13 |
| 3,447,331 | 6/1969 | Smith | 62/13 |
| 3,736,762 | 6/1973 | Toyama et al. | 62/13 |
| 4,222,756 | 9/1980 | Thorogood | 62/13 |

*Primary Examiner*—Frank Sever

*Attorney, Agent, or Firm*—Stanley Ktorides

[57] ABSTRACT

A cryogenic process to efficiently produce large quantities of nitrogen gas at elevated pressure by use of a double column and multiple condenser-reboilers.

18 Claims, 3 Drawing Figures

DOUBLE COLUMN MULTIPLE CONDENSER-REBOILER HIGH PRESSURE NITROGEN PROCESS

TECHNICAL FIELD

This invention relates generally to the field of cryogenic separation of air and more particularly to the field of cryogenic separation of air to produce nitrogen.

BACKGROUND ART

A use of nitrogen which is becoming increasingly more important is as a fluid for use in secondary oil or gas recovery techniques. In such techniques a fluid is pumped into the ground to facilitate the removal of oil or gas from the ground. Nitrogen is often the fluid employed because it is relatively abundant and because it does not support combustion.

When nitrogen is employed in such enhanced oil or gas recovery techniques it is generally pumped into the ground at an elevated pressure which may be from 500 to 10,000 psia or more.

The production of nitrogen by the cryogenic separation of air is well known. One well known process employs two columns in heat exchange relation. One column is at a higher pressure in which the air is preseparated into oxygen-enriched and nitrogen-rich fractions. The other column is at a lower pressure in which the final separation of the air into product is carried out. Such a double column process efficiently carries out the air separation and can recover a high percentage, up to about 90 percent, of the nitrogen in the feed. However such a process has a drawback when the nitrogen is desired for use in enhanced oil or gas recovery because the product nitrogen is at a relatively low pressure, generally between about 15–25 psia. This necessitates a significant amount of further compression of the nitrogen before it can be utilized in enhanced oil or gas recovery operations. This further compression is quite costly.

Also known are single column cryogenic air separation processes which produce high pressure nitrogen typically at a pressure of from about 70 to 90 psia. Nitrogen at such a pressure significantly reduces the cost of pressurizing the nitrogen to the level necessary for enhanced oil and gas recovery operations over the cost of pressurizing the nitrogen product of a conventional double column separation. However, such single column processes can recover only a relatively low percentage, up to about 60 percent, of the nitrogen in the feed air. Furthermore, if one carried out the separation in the column at a higher pressure in order to produce nitrogen at a higher pressure than 70–90 psia, one would experience an even lower recovery than the 60 percent referred to above.

Another known process for high pressure nitrogen production employs a conventional double column operated at elevated pressure levels. This arrangement is similar to the conventional double column arrangement but the feed air is at an elevated pressure and thereby the columns are operated at higher pressures. Since the upper column is operated at higher pressure than in the conventional double column arrangement, the product nitrogen is then available at that increased pressure level. However, this process has the disadvantage of requiring that all process fluids be handled in the upper column thus resulting in an increased size for the upper column. Another disadvantage is that the product nitrogen pressure is limited to the pressure of the upper or lower pressure column.

Still another known process for producing nitrogen at elevated pressure is disclosed in U.S. Pat. No. 4,222,756—Thorogood. This patent discloses the use of a double column having a reflux condenser in the upper column. This process produces elevated pressure nitrogen from the top of the upper column and develops reflux for that upper column by expanding high pressure oxygen-enriched liquid produced at the bottom of that upper column. However, this process also has the disadvantage of requiring that all process fluids be handled in the upper column thus resulting in an increased size for the upper column. Furthermore, this process is disdvantageous because the product nitrogen pressure is limited to the pressure of the upper or lower pressure column.

Yet another process for the production of high pressure nitrogen involves the draw of some product nitrogen from the top of the bottom or higher pressure column. The nitrogen from this point is commonly referred to as shelf vapor. This process is disadvantageous because the shelf vapor which is withdrawn as product is not available for use as reflux for the upper column. This has an adverse impact on the upper column reflux ratio resulting in reduced nitrogen recovery. Thus this process can be used efficiently only to produce small amounts of high pressure nitrogen.

Often it is desirable to have available oxygen, either at ambient or elevated pressure, for use in a process proximate to that which uses the elevated pressure nitrogen. For example, in one such situation it may be desirable to supply lower purity oxygen for combustion purposes to generate synthetic fuels and elevated pressure nitrogen for enhanced oil or gas recovery. Another such application could be in metal refineries and metalworking operations such as aluminum refineries which can utilize elevated pressure nitrogen for blanketing purposes and low purity oxygen for combustion. Although there are known processes to produce nitrogen and oxygen, it would be desirable to have a process which can produce large quantities of elevated pressure nitrogen and also produce some oxygen.

It is therefore an object of this invention to provide a double column cryogenic air separation process which will produce nitrogen at elevated pressure and at a high recovery.

It is another object of this invention to provide a double column cryogenic air separation process which will produce nitrogen at elevated pressure and at high recovery while avoiding the need to handle all the process streams in the upper column.

It is a further object of this invention to provide a double column cryogenic air separation process which will produce nitrogen at high recovery and at elevated pressure while not limiting the pressure of the product nitrogen to that of the upper or lower pressure column.

It is yet another object of this invention to provide a double column cryogenic air separation process which will produce nitrogen at elevated pressure and high recovery by withdrawing large amounts of nitrogen from the higher pressure column shelf vapor as product nitrogen while not adversely affecting upper column reflux ratios or upper column separation efficiency.

It is a still further object of this invention to provide a process to efficiently produce large quantities of elevated pressure nitrogen while also producing some oxygen.

SUMMARY OF THE INVENTION

The above and other objects which will become obvious to one skilled in the art upon a reading of this disclosure are attained by a process for the production of nitrogen gas at greater than atmospheric pressure by the separation of air by rectification comprising:

(A) introducing cleaned, cooled feed air at greater than atmospheric pressure into a high pressure column operating at a pressue of from about 80 to 300 psia;

(B) separating said feed air by rectification in said high pressure column into a first nitrogen-rich vapor fraction and a first oxygen-enriched liquid fraction;

(C) recovering from about 20 to 60 percent of said first nitrogen-rich vapor fraction as high pressure nitrogen gas;

(D) introducing said first oxygen-enriched liquid fraction into a medium pressure column which is in heat exchange relation with said high pressure column and is operating at a pressure lower than that of said high pressure column of from about 40 to 150 psia and in which feed introduced into said medium pressure column is separated by rectification into a second nitrogen-rich vapor fraction and a second oxygen-enriched liquid fraction;

(E) recovering from about 0 to 60 percent of said second nitrogen-rich vapor fraction as medium pressure nitrogen gas;

(F) condensing a portion of said first nitrogen-rich vapor fraction by indirect heat exchange with a portion of said second oxygen-enriched liquid fraction thereby producing a first nitrogen-rich liquid portion and a first oxygen-enriched vapor portion;

(G) employing at least some of said first nitrogen-rich liquid portion as liquid reflux for said high pressure column and said first oxygen-enriched vapor portion as vapor reflux for said medium pressure column;

(H) condensing at least a portion of said second nitrogen-rich vapor fraction by indirect heat exchange with a portion of said second oxygen-enriched liquid fraction thereby producing a second nitrogen-rich liquid portion and a second oxygen-enriched vapor portion;

(I) employing said second nitrogen-rich liquid portion as liquid reflux for said medium pressure column;

(J) employing said first nitrogen-rich liquid portion as additional liquid reflux for said medium pressure column in an amount equivalent to that of from about 0 to 40 percent of said first nitrogen-rich vapor fraction such that the sum of said amount and of the high pressure nitrogen gas recovered in step (C) is from about 20 to 60 percent of said first nitrogen-rich vapor fraction; and (K) removing from the process said second oxygen-enriched vapor portion.

The term "indirect heat exchange", as used in the present specification and claims, means the bringing of two fluid streams into heat exchange relation without any physical contact or intermixing of the fluids with each other.

The term, "column", as used in the present specification and claims, means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith et al, page 13-3, *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, chapter VII, Commercial Air Separation. Vapor and liquid contacting separation processes depend on the difference in vapor pressures for the components. Tne high vapor pressure (or more volatile or low boiler) component will tend to concentrate in tne vapor phase whereas the low pressure (or less volatile or high boiler) will tend to concentrate in the liquid phase. Distillation is the separation process whereby heating of a liquid mixture can be used to concentrate tne volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principle of rectification to separate mixtures are often interchangeably termed rectification columns, distillation columns, or fractionation columns.

The term "cleaned, cooled air" as used in the present specification and claims, means air which has been cleaned or impurities such as water vapor and carbon dioxide and is at a temperature below about 120° K., preferably below about 110° K.

The term "reflux ratio", as used in the present specification and claims, means the numerical ratio of the liquid flow to the vapor flow each expressed on a molal basis, that are countercurrently contacted within the column to effect separation.

The term "equivalent", as used in Step (J), is used in order to express a liquid in terms of a vapor and, as such, means equivalent on a mass basis rather than, for example, a volume basis.

DETAILED DESCRIPTION

The process of this invention will be described in detail with rererence to the drawings.

Figure 1:
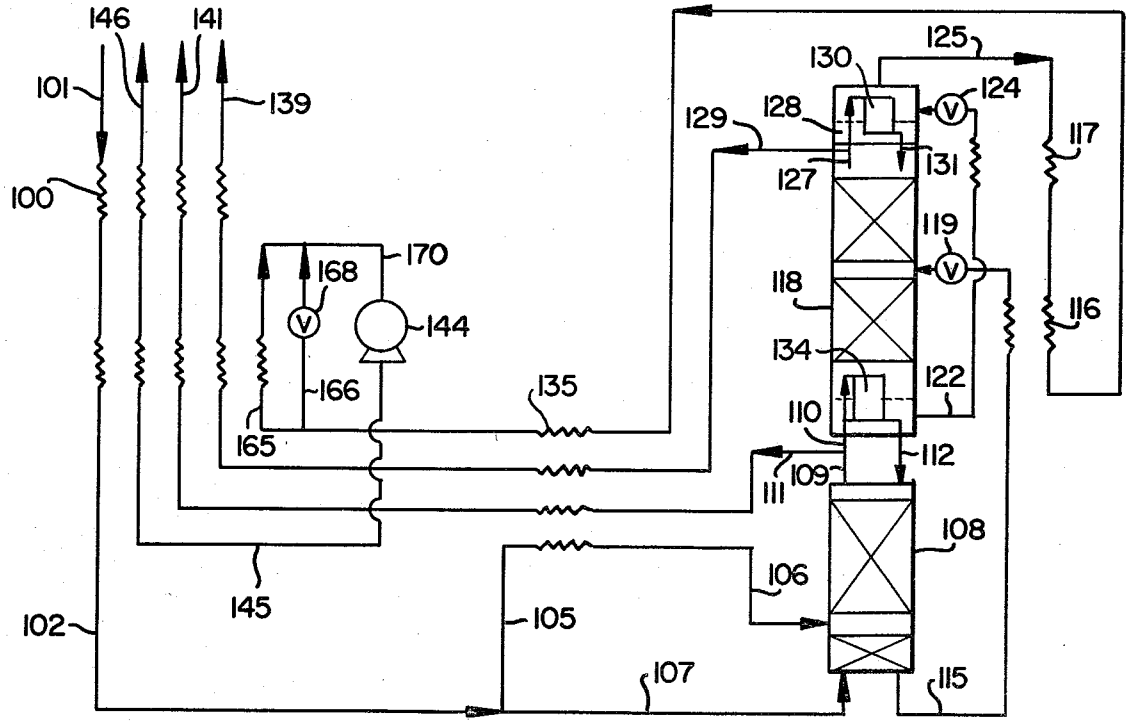
FIG. 1 is a schematic representation of one preferred embodiment of the process of this invention wherein none of the first nitrogen-rich liquid portion is employed as liquid reflux for the medium pressure column and an oxygen stream is expanded to provide plant refrigeration.

Referring now to FIG. 1, pressurized feed air 101 is passed through desuperheater 100 where it is cooled and cleaned of impurities, such as water vapor and carbon dioxide, and from where it emerges in a close-to-saturated condition at 102. The cooled pressurized feed air stream 102 is divided into a minor fraction 105 and major fraction 107. Stream 105 is employed to superheat return streams in heat exchanger 135, and after condensation, is introduced as liquid air stream 106 into high pressure column 108 whicn is operating at a pressure of from 80 to 300 psia, preferably from 90 to 240 psia, most preferably from 100 to 200 psia. Stream 107 is introduced to the bottom of column 108 as high pressure vapor feed. In column 108 the feed air is separated by rectification into a first nitrogen-rich vapor fraction and a first oxygen-enriched liquid fraction. The first nitrogen-rich vapor fraction 109 is diviced into portion 111, which comprises from 20 to 60 percent of fraction 109, preferably from 30 to 50 percent, most preferably from 35 to 45 percent, and which is removed from column 108, passed through heat exchanger 135 and desuperheater 100 and recovered as product high pressure nitrogen gas 141 at about ambient temperature. The remaining portion 110 of the first nitrogen-rich vapor reaction is introduced into condenser 134. The first oxygen-enriched liquid fraction is removed from the bottom of column 108 as stream 115, is subcooled in heat eachanger 116 against return stream 125 from medium pressure column 118, expanded through valve 119 and introduced into medium pressure column 118 which is operating at a pressure, lower than the pressure of high pressure column 108, of from about 40 to 150 psia, preferably from about 45 to 120 psia, most preferably from about 50 to 90 psia.

In column 118 the input is separated by rectification into a second nitrogen-rich vapor fraction and a second oxygen-enriched liquid fraction. The second oxygen-enriched liquid fraction is partially vaporized in condenser 134 by indirect heat exchange with portion 110 of the first nitrogen-rich fraction to produce vapor reflux for the medium pressure column. The resulting condensed first nitrogen-rich liquid portion 112 is returned to the higher pressure column 108 as liquid reflux.

A portion 122 of the second oxygen-enriched liquid fraction is removed from the bottom of the medium pressure column 118, subcooled in heat exchanger 117 against return stream 125, expanded through valve 124 and introduced into condenser 130 where it is vaporized to produce oxygen-enriched stream 125. This stream is used as the cooling stream in heat exchangers 117 and 116 and is then passed through heat exchanger 135 and is expanded to provide plant refrigeration as will be further explained later.

The second nitrogen rich vapor fraction 127 is divided into stream 129 and stream 128. Stream 129 comprises from 0 to 60 percent of fraction 127, preferably from 20 to 50 percent, most preferably from 35 to 45 percent, and is removed from medium pressure column 118, passed through heat exchanger 135 and desuperheater 100, and recovered as medium pressure nitrogen gas 139 at about ambient temperature. The remaining portion 128 is condensed in heat exchanger 130 to produce second nitrogen-rich liquid portion 131 which is employed as liquid reflux for the medium pressure column.

FIG. 1 illustrates a preferred embodiment wherein oxygen stream 125 is expanded to provide plant refrigeration. Stream 125 is superheated in heat exchanger 135, and is divided into streams 165 and 166. Stream 165 is warmed by partial traverse of heat exchanger 100. Stream 166 is expanded through valve 168 and added at an equivalent pressure to stream 165 to form combined waste stream 170 which is turboexpanded in turbine 144 to provide plant refrigeration. The resulting low pressure cooled stream 145 is passed through desuperheater 100 and removed as ambient temperature stream 146.

As is shown, the process of this invention can produce large amounts of high and medium pressure nitrogen at high efficiency. Portion 111 which is removed from the high pressure column and recovered as high pressure nitrogen gas product comprises a significantly greater amount of the nitrogen in the feed air than has been heretofore possible. This portion 111 can be removed without adversely affecting the reflux ratio in the medium pressure column. Heretofore in a double column separation process the removal from the higher pressure column of a significant portion of shelf vapor, represented by stream 111 in FIG. 1, would lead to a reduction in the amount of liquid reflux available for the lower pressure column because at least about 40 percent of the shelf vapor must be returned to the higher pressure column after condensation for use as liquid reflux. If a large part or the shelf vapor were withdrawn as product this would result in the lower pressure colunm operating at an inefficient reflux ratio. The process of this invention solves this problem by supplying a compensating amount of liquid reflux to the lower pressure column so as to compensate for the loss of liquid reflux due to the removal of high pressure and medium pressure nitrogen-rich streams from the process, and keep the lower pressure column reflux ratio within a range which will result in good separation. This compensation is accomplished by removing some of the second oxygen-enriched liquid fraction from the upper column and employing this liquid to generate liquid reflux by condensing nitrogen-rich vapor in a condenser at the top of the lower pressure column.

Table I lists tne results of a computer simulation of the process of this invention carried out in accord with the embodiment of FIG. 1 wherein the high pressure nitrogen gas recovered was about 40 percent ot the first nitrogen-rich vapor fraction. The stream numbers correspond to those of FIG. 1. The nitrogen recovery for the process listed in Table I is 77 percent. The abbreviation mcfh, means thousand cubic feet per hour at standard conditions.

TABLE I

| Stream | Number | Value |
|---|---|---|
| Feed Air | 101 | |
| Flow, mcfh | | 3205 |
| Pressure, psia | | 148 |
| Oxygen at Top Condenser | 125 | |
| Flow, mcfh | | 1158 |
| Purity, percent $O_2$ | | 58 |
| Pressure, psia | | 28 |
| Oxygen at Warm End | 146 | |
| Flow, mcfh | | 1158 |
| Purity, percent $O_2$ | | 58 |
| Pressure, psia | | 15 |
| High Pressure Nitrogen Product | 141 | |
| Flow, mcfh | | 1225 |
| Purity, ppm $O_2$ | | 4 |

TABLE I-continued

| Stream | Number | Value |
|---|---|---|
| Pressure, psia | | 138 |
| Medium Pressure Nitrogen Product | 139 | |
| Flow, mcfh | | 822 |
| Purity, ppm $O_2$ | | 4 |
| Pressure, psia | | 72 |

Figure 2:
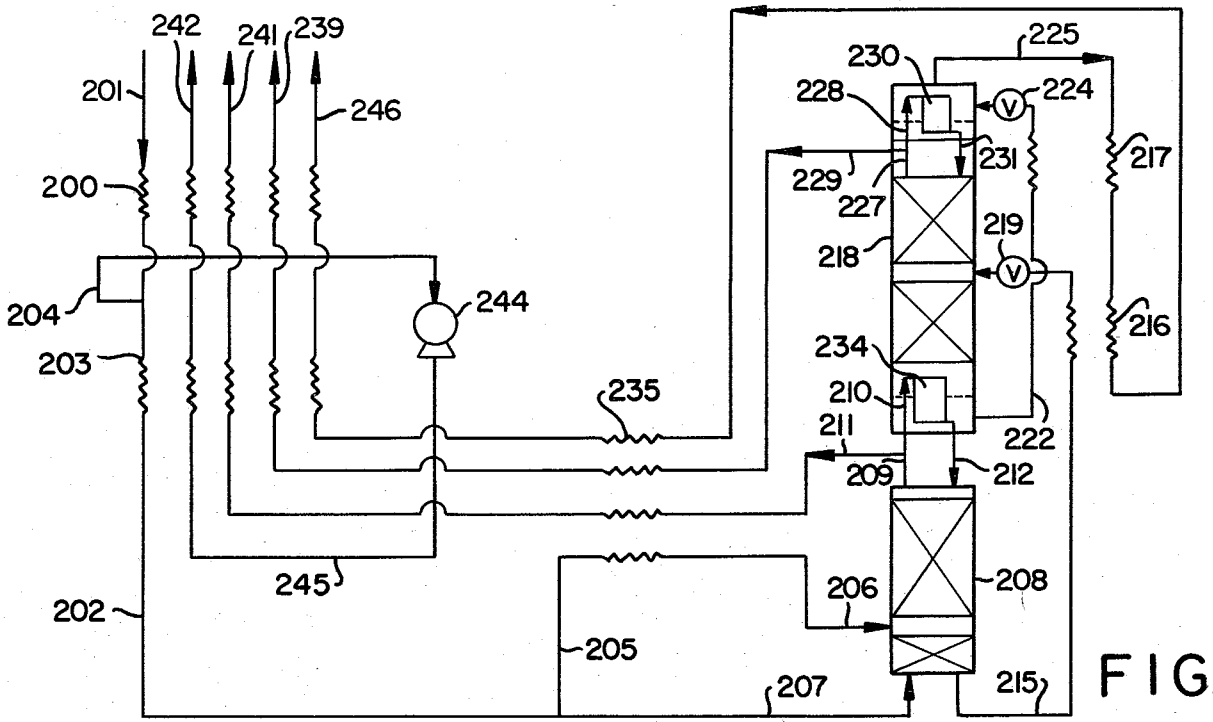
FIG. 2 is a schematic representation of another preferred embodiment of the process of this invention wherein an air stream is expanded to provide plant refrigeration.

FIG. 2 illustrates yet another embodiment of the process of this invention. In FIG. 2 the numerals correspond to those of FIG. 1 plus 100 for the elements common to both. In accord with the FIG. 2 embodiment feed air 201 is passed through hear exchanger 200 but a small fraction 204 passes only partially through. The major part 203 completely traverses heat exchanger 200 and emerges as stream 202. Stream 204, called the excess air fraction, is turboexpanded through turbine 244 to provide plant refrigeration and passed 245 through heat exchanger 200 and released 242. The remainder ot the FIG. 2 embodiment is similar to that of FIG. 1 except that oxygen stream 225 is not turboexpanded.

Figure 3:
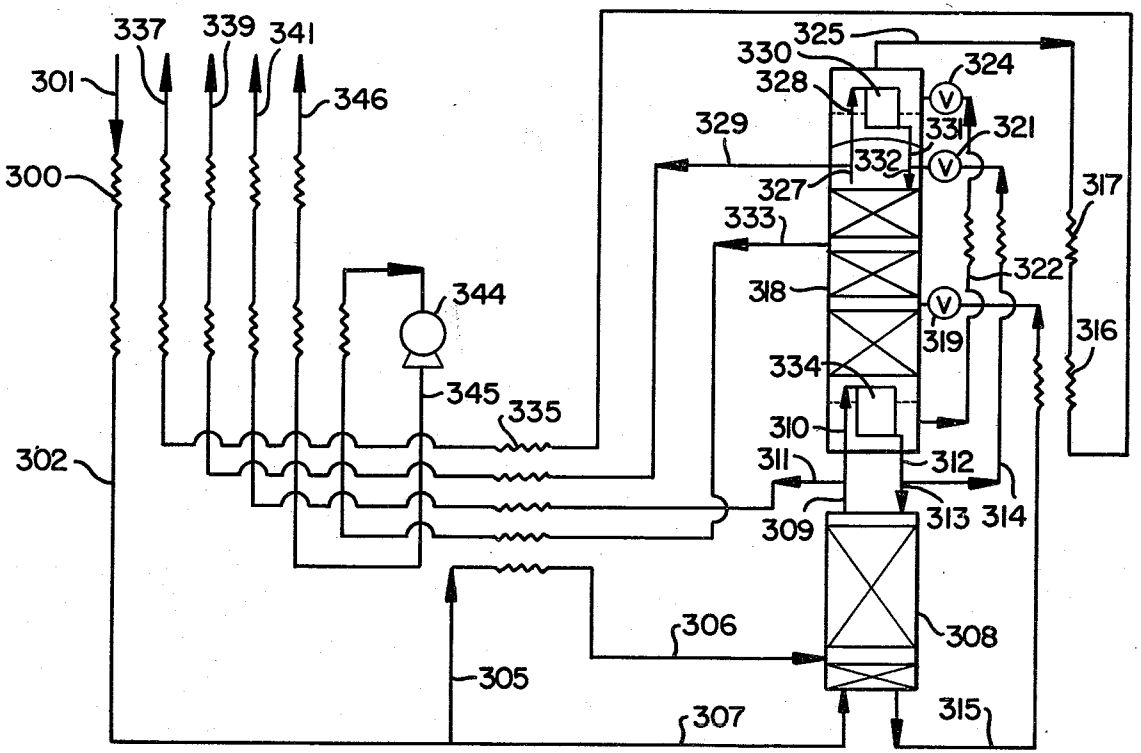
FIG. 3 is a schematic representation of another preferred embodiment of the process of this invention wherein some of the first nitrogen-rich liquid portion is employed as liquid reflux for the medium pressure column.

As shown, the process of this invention in accord with FIGS. 1 or 2 will efficiently produce large amounts of high and medium pressure nitrogen. In some situations it may be desirable to also produce some oxygen at a purity greater than the purity obtainable with the FIG. 1 embodiment. If one desired to obtain oxygen at such an increased purity while still efficiently producing nitrogen at elevated pressure, one could carry out the process of this invention in accord with the embodiment of FIG. 3. In FIG. 3, the numerals correspond to those of FIG. 1 plus 200 for the elements common to both.

Referring now to FIG. 3, the process is carrried out similarly to the process described with reference to FIG. 1 except that the first nitrogen-rich liquid portion 312 is not entirely returned to high pressure column 308 as liquid reflux. Instead stream 312 is divided into stream 313 which is returned to high pressure column 308 as liquid reflux, and into stream 314 which is cooled in heat exchanger 317 expanded through valve 324 and combined with stream 331 to form combined liquid reflux stream 332. This arrangement allows the production of oxygen at a higher purity than that of the FIGS. 1 or 2 arrangements. Since the medium pressure column can now utilize a dual source of reflux liquid, the oxygen stream can be a lower quantity and thereby at a higher purity. Up to, the equivalent on a mass basis, about 40 percent of the first nitrogen-rich vapor fraction can be employed after condensation as liquid reflux for the medium pressure column. As can be appreciated, the purity of oxygen product that can be attained by the process illustrated in FIG. 3 is inversely related to the amount of high pressure nitrogen which can be produced by withdrawal as stream 311. Thus high pressure nitrogen production is maximized when none of the first nitrogen-rich liquid portion is used as medium pressure column reflux, and oxygen purity is maximized when about 40 percent of the mass of the first nitrogen vapor fraction, after condensation to produce the first nitrogen-rich liquid portion, is used as medium pressure column reflux. However the combined amounts of high pressure nitrogen gas recovered and first nitrogen-rich liquid portion used as medium pressure column reflux should not exceed, on a mass basis, about 60 percent of the first nitrogen-rich vapor fraction. Preferably this combined amount is from 30 to 50 percent of the first nitrogen-rich vapor fraction. This will assure sufficient reflux to be returned to the high pressure column to allow it to effectively carry out the separation by rectification. Furthermore the capability of producing higher purity oxygen results in improved nitrogen recovery and is a further advantage of the process of this invention over any known prior art processes that do not employ dual reflux supply.

In some situations it may be desirable to obtain the oxygen product at an elevated rather than at ambient pressure. Such oxygen may be recovered at a pressure of up to about 40 psia. When the product oxygen pressure is increased, the two product nitrogen pressure levels will also be increased. The high pressure nitrogen product will be at the highest pressure corresponding to about the pressure of the high pressure column. The medium pressure nitrogen product will be at about the pressure of the medium pressure column which must be lower than that of the high pressure column so that the heat exchange in condenser 334 can take place. Similarly, the pressure of the product oxygen must be lower than that of the medium pressure column in order to allow the heat exchange in condenser 330. Alternatively a small fraction of the oxygen could be withdrawn from the bottom of the medium pressure column or from a few equilibrium stages above the bottom and recovered as elevated pressure oxygen.

Although the process of this invention has been described in detail with reference to three preferred embodiments, those skilled in the art will recognized that there are many other embodiments of the process which can be practiced. For example, one may desire to produce some liquid nitrogen product in addition to the gaseous nitrogen product by removing and recovering some of the top reflux from either column. In another embodiment, one may wish to feed the condensed air stream, after superheating the return streams, to the medium rather than the high pressure column. In yet another embodiment one may desire to employ a feed air fraction or the high pressure product nitrogen to develop plant refrigeration rather than the waste nitrogen stream. When an air fraction is used to develop plant refrigeration, that fraction may be then introduced into a column as feed or, as is shown in FIG. 2, it may be passed through the desuperheater and out of the process so as to regenerate ambient temperature adsorption beds used in air precleaning. Also, a small part of the first nitrogen-rich vapor fraction could also be expanded to control air desuperheater temperature profiles and develop plant refrigeration and then introduced to the medium pressure column. Another alternative could employ a waste nitrogen stream from the medium pressure column for expansion to generate plant refrigeration. Such a stream could be advantageously employed to help control medium pressure colum reflux ratios. Still another alternative could be the introduction of the first oxygen-enriched liquid fraction into the bottom of the medium pressure column instead of above the bottom as shown in the figures.

By the use of the present invention, one can now produce large quantities of elevated pressure nitrogen at high recovery by the employment of a double column arrangement. If desired, one can also employ the process of this invention to produce some oxygen either at ambient or elevated pressure.

We claim:

1. A process for the production of relatively large quantities of nitrogen gas at greater than atmospheric pressure by the separation of air by rectification comprising:

(A) introducing cleaned, cooled feed air at greater than atmospheric pressure into a high pressure column operating at a pressure of from about 80 to 300 psia;

(B) separating said feed air by rectification in said high pressure column into a first nitrogen-rich vapor fraction and a first oxygen-enriched liquid fraction;

(C) recovering from about 20 to 60 percent of said first nitrogen-rich vapor fraction as high pressure nitrogen gas at a pressure in the range of from 80 to 300 psia;

(D) introducing said first oxygen-enriched liquid fraction into a medium pressure column which is in heat exchange relation with said high pressure column and is operating at a pressure lower than that of said high pressure column of from about 40 to 150 psia and in which feed introduced into said medium pressure column is separated by rectification into a second nitrogen-rich vapor fraction and a second oxygen-enriched liquid fraction;

(E) recovering from about 0 to 60 percent of said second nitrogen-rich vapor fraction as medium pressure nitrogen gas;

(F) condensing a portion of said first nitrogen-rich vapor fraction by indirect heat exchange with a portion of said second oxygen-enriched liquid fraction thereby producing a first nitrogen rich liquid portion and a first oxygen-enriched vapor portion;

(G) employing at least some of said first nitrogen-rich liquid portion as liquid reflux for said high pressure column and said first oxygen-enriched vapor portion as vapor reflux for said medium pressure column;

(H) condensing at least a portion of said second nitrogen-rich vapor fraction by indirect heat exchange with a portion of said second oxygen-enriched liquid fraction thereby producing a second nitrogen-rich liquid portion and second oxygen-enriched vapor portion;

(I) employing said second nitrogen-rich liquid portion as liquid reflux for said medium pressure column;

(J) employing said first nitrogen-rich liquid portion as additional liquid reflux for said medium pressure column in an amount equivalent to that of from about 0 to 40 percent of said first nitrogen-rich vapor fraction such that the sum of said amount and of the high pressure nitrogen gas recovered in step (C) is from about 20 to 60 percent of said first nitrogen-rich vapor fraction; and (K) removing from the process said second oxygen-enriched vapor portion.

2. The process of claim 1 wherein all of said first nitrogen-rich liquid portion of step (G) is employed as liquid reflux for said high pressure column.

3. The process of claim 1 wherein in step (C) from about 30 to 50 percent of said first nitrogen-rich vapor fracion is recovered as high pressure nitrogen gas.

4. The process of claim 1 wherein in step (C) from about 35 to 45 percent or said first nitrogen-rich vapor fraction is recovered as high pressure nitrogen gas.

5. The process or claim 1 wherein said high pressure column is operating at a pressure of from about 90 to 240 psia.

6. The process or claim 1 wherein said high pressure column is operating at a pressure of from about 100 to 200 psia.

7. Tne process of claim 1 wherein said medium pressure column is operating at a pressure of from about 45 to 120 psia.

8. The process of claim 1 wherein said medium pressure column is operating at a pressure of from about 50 to 90 psia.

9. The process of claim 1 wherein in step (D) said first oxygen-enriched liquid fraction is introduced into said medium pressure column at the bottom of said column.

10. The process or claim 1 wherein in step (D) said first oxygen-enriched liquid fraction is introduced into said medium pressure column above the bottom of said column.

11. The prooess ot claim 1 wherein a part of the first nitrogen-rich vapor fraction is removed from the high pressure column, expanded, and introduced into the medium pressure column.

12. The process or claim 1 wherein a nitrogen-rich vapor stream is removed from said medium pressure column at a point intermediate the respective points where said first oxygen-enriched liquid fraction and said second nitrogen-rich liquid portion are introduced into said medium pressure column, and is warmed, expanded and removed from the process.

13. The process of claim 1 wherein in step (E) from about 20 to 50 percent of said second nitrogen-rich vapor fraction is recovered as medium pressure nitrogen gas.

14. The process of claim 1 wherein in step (E) from about 35 to 45 percent of said second nitrogen-rich vapor fraction is recovered as medium pressure nitrogen gas.

15. The process or claim 1 wherein in step (J) said sum is from about 30 to 50 percent of said first nitrogen-rich vapor fraction.

16. The process of claim 1 wherein said second oxygen-enriched vapor portion is recovered as product oxygen.

17. The process of claim 1 wherein at least a portion of said second oxygen-enrich vapor portion is warmed and expanded prior to removal from the process.

18. The process or claim 1 wherein an amount of air in excess of what is required as feed air is expanded, warmed by indirect heat exchange with feed air, and removed from the process.

* * * * *